US010242822B2

(12) United States Patent
Bresciani et al.

(10) Patent No.: US 10,242,822 B2
(45) Date of Patent: Mar. 26, 2019

(54) SWITCHING DEVICE WITH A SUSPENDED MOBILE CONTACT ASSEMBLY

(71) Applicant: ABB S.p.A., Milan (IT)

(72) Inventors: Nicola Bresciani, Bergamo (IT); Roberto Rota Martir, Brembate Sopra (IT)

(73) Assignee: ABB S.p.A., Milan (IT)

( * ) Notice: Subject to any disclaimer, the term of this patent is extended or adjusted under 35 U.S.C. 154(b) by 5 days.

(21) Appl. No.: 15/402,999

(22) Filed: Jan. 10, 2017

(65) Prior Publication Data

US 2017/0200574 A1 Jul. 13, 2017

(30) Foreign Application Priority Data

Jan. 11, 2016 (EP) ..... 16150771

(51) Int. Cl.
*H01H 21/30* (2006.01)
*H01H 21/36* (2006.01)
(Continued)

(52) U.S. Cl.
CPC ..... *H01H 21/30* (2013.01); *H01H 1/2041* (2013.01); *H01H 1/225* (2013.01); *H01H 21/36* (2013.01); *H01H 71/1009* (2013.01)

(58) Field of Classification Search
CPC ..... H01H 21/30; H01H 1/2041; H01H 21/36; H01H 71/1009; H01H 1/225
(Continued)

(56) References Cited

U.S. PATENT DOCUMENTS 2,218,374 A * 10/1940 Atwood ..... H01H 71/1009 200/17 R
2002/0153978 A1 10/2002 Greenburg et al.
2008/0185275 A1* 8/2008 Curnis ..... H01H 71/0207 200/335

FOREIGN PATENT DOCUMENTS

EP 1003192 A2 5/2000
EP 1003192 A3 5/2000
(Continued)

OTHER PUBLICATIONS

European Search Report dated Jul. 3, 2016; European Patent Application No. EP16150771; 9 pgs.

*Primary Examiner* — Edwin A. Leon
*Assistant Examiner* — Lheiren Mae A Caroc
(74) *Attorney, Agent, or Firm* — Taft Stettinius & Hollister LLP; J. Bruce Schelkopf

(57) ABSTRACT

The present application contemplates a switching device comprising: an outer casing defining an internal volume of the switching device; one or more electric poles, each electric pole comprising one or more mobile contacts and one or more contacts adapted to be coupled or uncoupled during a switching operation of the switching device; a contact shaft accommodated in the internal volume of the switching device and adapted to rotate about a rotation axis during a switching operation of the switching device, the contact shaft having a body comprising one or more contact seats to accommodate at least partially the mobile contacts, so that the mobile contacts rotate with the contact shaft about the rotation axis during a switching operation of the switching device; a control mechanism comprising a supporting frame fixed to the outer casing to provide support to movable members of the control mechanism and one or more connecting rods to provide a force to move the contact shaft during a switching operation of the switching device.

20 Claims, 12 Drawing Sheets

(51) Int. Cl.
*H01H 1/20* (2006.01)
*H01H 1/22* (2006.01)
*H01H 71/10* (2006.01)

(58) Field of Classification Search
USPC ..... 200/335, 244, 400
See application file for complete search history.

(56) References Cited

FOREIGN PATENT DOCUMENTS

| | | | |
|---|---|---|---|
| EP | 1194941 | A2 | 4/2002 |
| WO | 0159634 | A3 | 9/2001 |
| WO | 0169634 | A2 | 9/2001 |
| WO | 2006120149 | A1 | 11/2006 |

* cited by examiner

SWITCHING DEVICE WITH A SUSPENDED MOBILE CONTACT ASSEMBLY

The present invention relates to the field of switching devices (such as circuit breakers, contactors, disconnectors and the like) for low voltage applications.

More particularly, the present invention relates to a low voltage switching device of the type provided with a suspended rotating mobile contact assembly.

For the purposes of the present application, the term "low voltage" (LV) relates to operating voltages lower than 1 kV AC and 1.5 kV DC.

As is known, switching devices for LV applications comprise one or more electric poles, each comprising one or more mobile contacts and fixed contacts that can be mutually coupled/uncoupled. Some known switching devices, such as the one disclosed in the patent application no. WO2006/120149A1, are provided with a suspended mobile contact assembly.

Typically, the mobile contact assembly comprises a rotating contact shaft having seats for accommodating the mobile contacts.

The mobile contact assembly is maintained in an operative position by suitable support elements that are solidly fixed with the outer casing of the switching device and are hinged with the contact shaft to allow the rotation of this latter about a rotation axis (suspended mobile contact assembly).

The mobile contact assembly is operated by a suitable control mechanism having connecting members (which basically do not have support functions) hinged with the contact shaft.

Such a control mechanism is adapted to provide a force to rotate the contact shaft during a switching operation of the switching device so that, upon a rotation of said shaft, the mobile contacts of the switching device are moved from a coupling position to an uncoupling position with the corresponding fixed contacts (opening manoeuvre of the switching device), or vice-versa (closing manoeuvre of the switching device).

The switching devices of the type described above have proven to be rather difficult to assembly at industrial level.

Specifically, the arrangement of the suspended mobile contact assembly is often quite time-consuming to carry out at industrial level, as several parts and components need to be mutually interconnected to mount said assembly in its correct operative position.

Further, severe mechanical tolerances have to be adhered during the mounting and installation of said mobile contact assembly to ensure a proper operation thereof during the maneuvers of the switching device.

The evidenced structural complexity of the interconnections between the mobile contact assembly and the supporting elements thereof or between the mobile contact assembly and the control mechanism makes often difficult possible maintenance interventions, particularly when these latter are directed to the mobile contacts of the switching device.

Obviously, the above mentioned drawbacks entail relatively high operative costs for the switching devices of this type.

It is an object of the present invention to provide a switching device of the type with suspended mobile contact assembly, which allows overcoming the above-mentioned problems.

More in particular, it is an object of the present invention to provide a switching device having a simplified structure, in particular for what concerning the arrangements to support and operate the mobile contact assembly.

A further object of the present invention is to provide a switching device, in which maintenance interventions can be easily carry out, with particular regard to the mobile contacts of the switching device.

Another object of the present invention is to provide a switching device easier and cheaper to manufacture and assembly at industrial level with respect to currently available switching devices of the same type.

In order to achieve these aim and objects, the present invention provides a switching device, according to the following claim 1 and related dependent claims.

According to a general definition, the switching device of the invention comprises:

- an outer casing defining an internal volume of said switching device;
- one or more electric poles, each electric pole comprising one or more mobile contacts and one or more contacts adapted to be coupled or uncoupled during a switching operation of said switching device;
- a contact shaft accommodated in the internal volume of said switching device and adapted to rotate about a rotation axis during a switching operation of said switching device, said contact shaft having a shaped body comprising one or more contact seats adapted to accommodate at least partially said mobile contacts, so that said mobile contacts rotate with said contact shaft about said rotation axis during a switching operation of said switching device;
- a control mechanism for operating said contact shaft, said control mechanism comprising a supporting frame fixed to said outer casing to provide support to movable members of said control mechanism and one or more connecting rods to provide a force to move said contact shaft during a switching operation of said switching device.

According to the invention, the switching device comprises one or more coupling elements (to support said contact shaft and provide a mechanical connection between said control mechanism and said contact shaft.

Said coupling elements comprise:

- a first coupling point, at which said coupling elements are fixed to said contact shaft, so that said coupling element provide support to said contact shaft and maintain said contact shaft in relative position with respect to said outer casing;
- a second coupling point, at which said coupling elements are hinged with one or more corresponding supporting frame portions of the supporting frame of said control mechanism, so that said coupling elements provide a centre of rotation for said contact shaft about said rotation axis;
- a third coupling point, at which said coupling elements are hinged with one or more corresponding connecting rods of said control mechanism, so that said connecting rods exert a force on said coupling elements to rotate said coupling elements and said contact shaft about said rotation axis, during a switching operation of said switching device.

According to an aspect of the invention, said coupling elements are configured as a lever, in which said first coupling point is the point of said lever on which a mechanical load is applied, said second coupling point is the fulcrum point of said lever and said third coupling point is the point of said lever on which a force is applied.

In according to this aspect of the invention, said coupling elements operate as a lever of first type with an intermediate fulcrum.

According to an aspect of the invention, said coupling elements comprise:

at least a supporting portion fixed with said contact shaft at said first coupling point and hinged with a corresponding supporting frame portion at said second coupling point;

at least a driving portion hinged with a corresponding connecting rod at said third coupling point and with a corresponding supporting frame portion at said second coupling point.

According to an aspect of the invention, said coupling elements are at least partially accommodated in one or more corresponding coupling recesses of said contact shaft.

According to an aspect of the invention, said coupling elements are formed by at least a shaped plate (preferably L-shaped) comprising a supporting leg forming said supporting portion, and a driving leg extending between said second and third coupling points and forms said driving portion.

Further characteristics and advantages of the present invention will emerge from the description of preferred, but not exclusive, embodiments, non-limiting examples of which are provided in the attached drawings, wherein.

Figure 9:
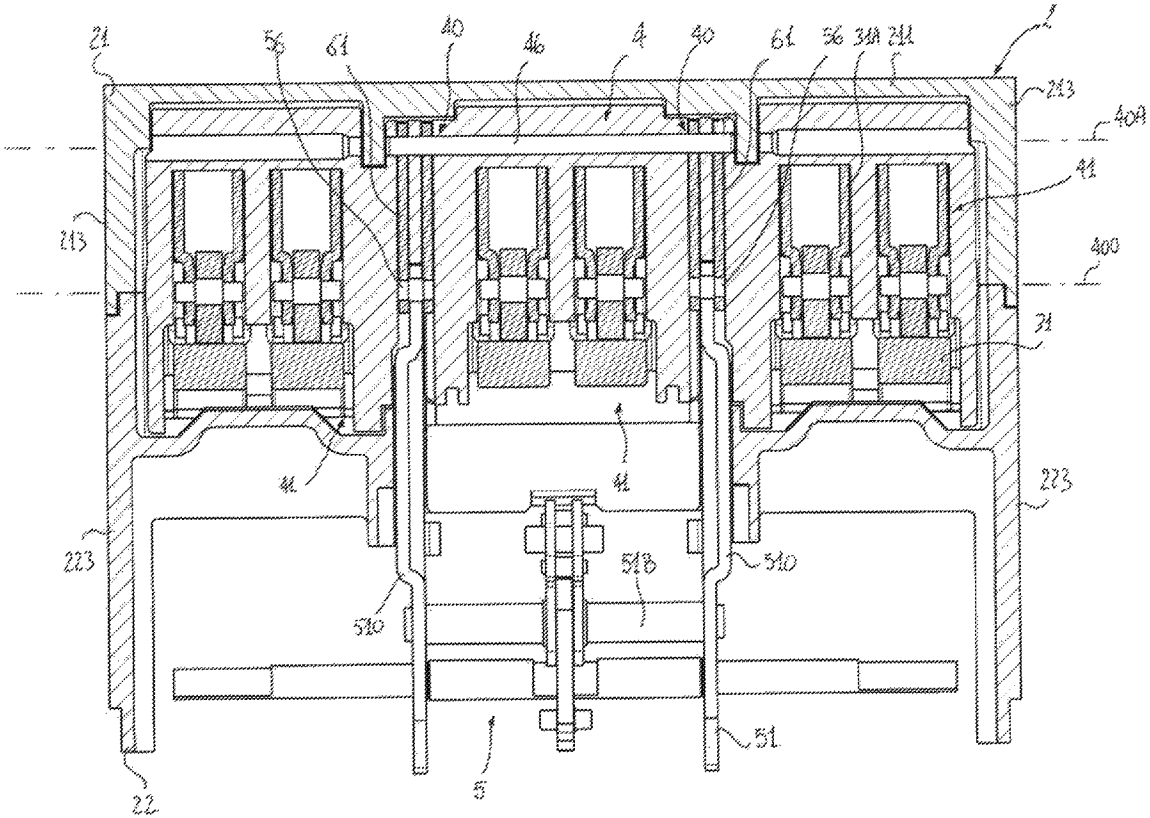
Figure 9A:
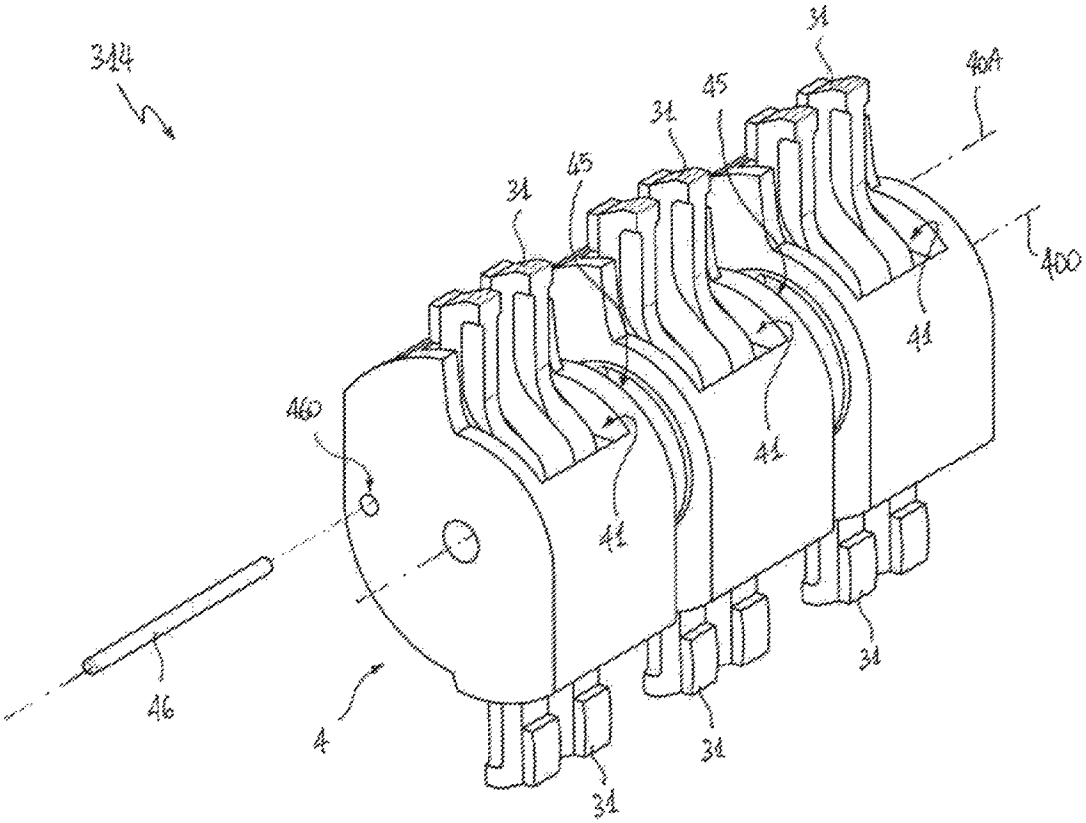

FIG. 9A schematically shows a portion of a further embodiment of the switching device, according to the invention.

Figure 10:
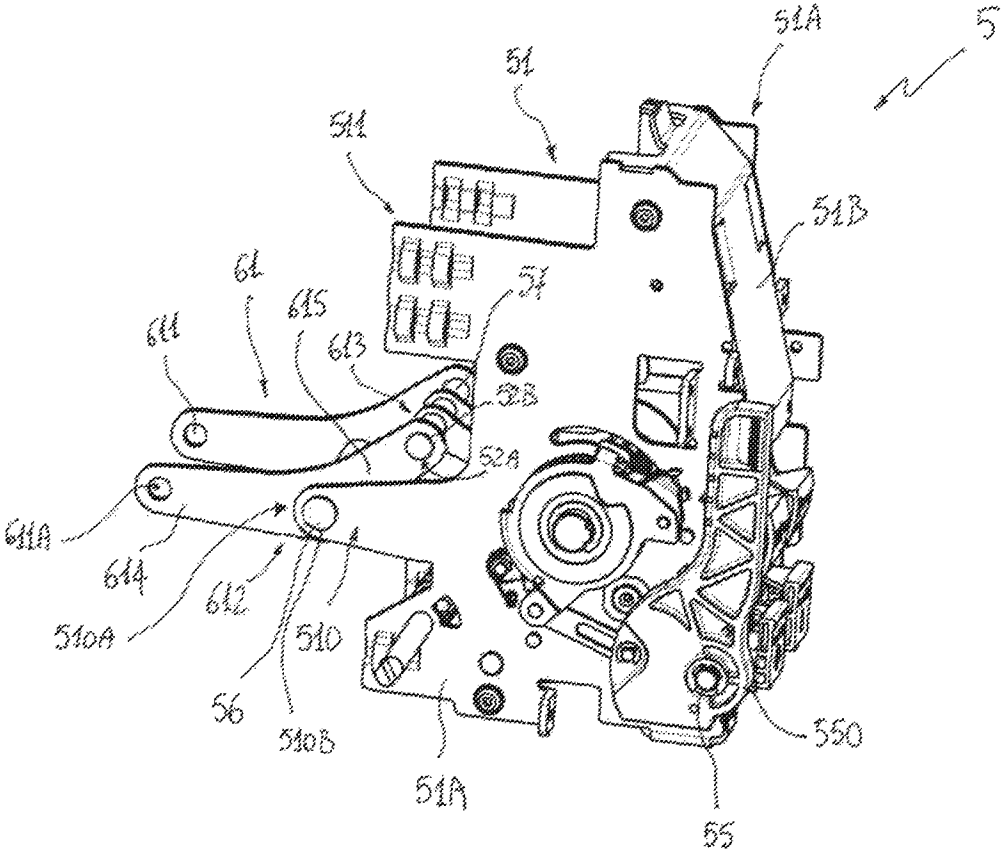

FIG. 10 shows a schematic partial view of a further embodiment of the switching device, according to the invention.

Referring to the cited figures, the present invention relates to a switching device 1 suitable to be installed in a LV electric switchgear panel or, more generally, in a LV electric power distribution grid.

According to the invention, the switching device 1 comprises an outer casing 2 that defines an internal volume 101-102 of the switching device.

Preferably, the outer casing 2 comprises a rear portion 21, a front portion 22 and a cover portion 23.

Preferably, the rear portion 21 comprises opposite first and second sides 211, 212 and opposite first lateral sides 213.

In a normal vertical installation of the switching device, the first side 211 defines at least partially a back side of the outer casing 2, at which the switching device can be fixed to a support, whereas the first lateral sides 213 define corresponding portions of the lateral sides of the outer casing 2.

Preferably, the front portion 212 comprises opposite third and fourth sides 221, 222 and opposite second lateral sides 223. In a normal vertical installation of the switching device, the lateral sides 223 define corresponding portions of the lateral sides of the outer casing 2.

The rear portion 21 and the front portion 22 are mutually coupled at the respective second and third sides 212, 221, which are advantageously shaped so as to define a first internal volume portion 101 adapted to accommodate the components of the switching device, which are electrically powered at the operating voltages thereof, e.g. the electric contacts, the mobile contact assembly or the arc-chambers of the switching device.

Advantageously, at the respective coupled sides 212-221, the portions 21, 22 of the outer casing 2 comprise protrusions and cavities at least partially geometrically conjugated or complementary to define the first internal volume portion 101 and ensure a suitable mutual mechanical coupling.

Preferably, the cover portion 22 comprises opposite fifth and sixth sides. In a normal vertical installation of the switching device, the sixth side 232 defines at least partially a front side of the outer casing 2, at which the switching device can be accessed by a user.

The front portion 22 and the cover portion 23 are mutually coupled at the respective fourth and fifth sides 222, 231 advantageously shaped to define a second internal volume portion 102 electrically segregated from the first internal volume portion 101 and adapted to accommodate components of the switching device, which are not electrically powered at the operating voltages thereof, e.g. mechanical components of the switching device.

Advantageously, at the respective coupled sides 222-231, the portions 22, 23 of the outer casing 2 comprise protrusions and cavities at least partially geometrically conjugated or complementary to define the second internal volume portion 102 and ensure a suitable mutual mechanical coupling.

Preferably, the switching device 1 comprises first fastening means 180 for the mechanical coupling of the different portions 21, 22, 23, 24 of the outer casing 2. The fastening means 180 may be of known type, such as screws, bolts or tie-rods.

Preferably, the outer casing 2 is made of an electrically insulating material (e.g. a thermosetting resin), which may be of known type.

However, in some applications (e.g. when the switching device 1 is an air circuit breaker), the outer casing 2, or some portions thereof, can be made of an electrically conductive material. Of course, in these cases, suitable insulating elements need to be arranged between the electrically powered components (e.g. the electric contacts) of the switching device and the outer casing 2.

Figure 1:
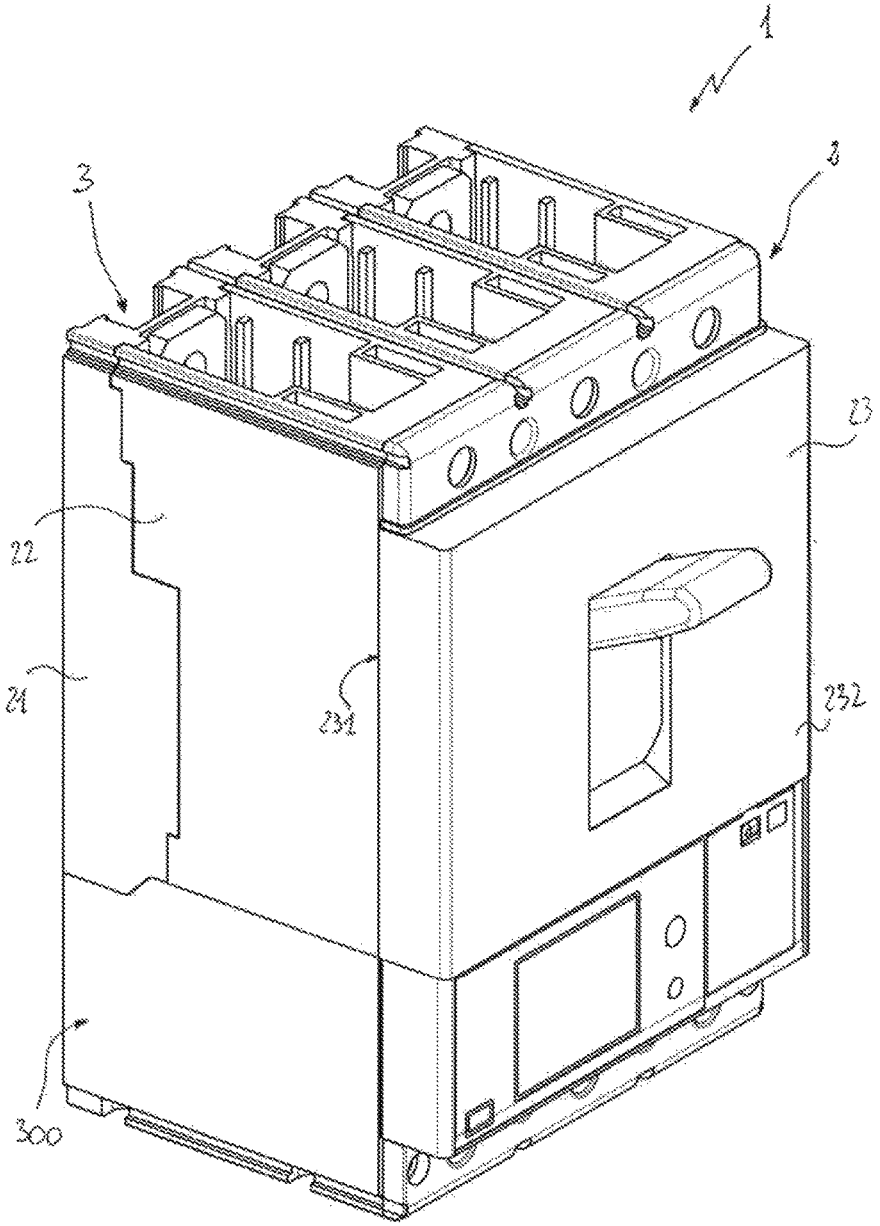
FIG. 1 shows a schematic view of an embodiment of the switching device, according to the invention.
Figure 2:
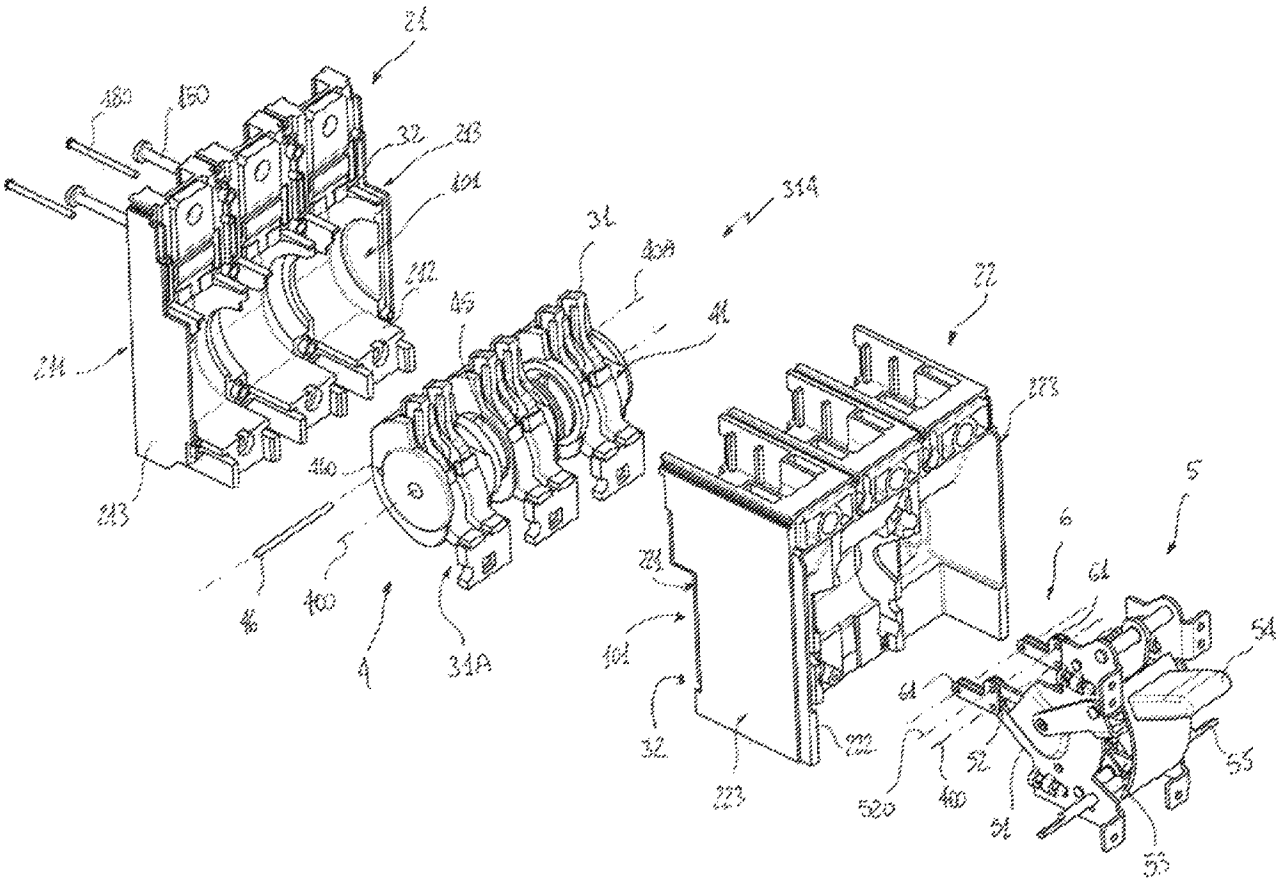
FIGS. 2-4, 4A-4C, 5-8, 8A, 9 show further schematic partial views of FIG. 1.
Figure 3:
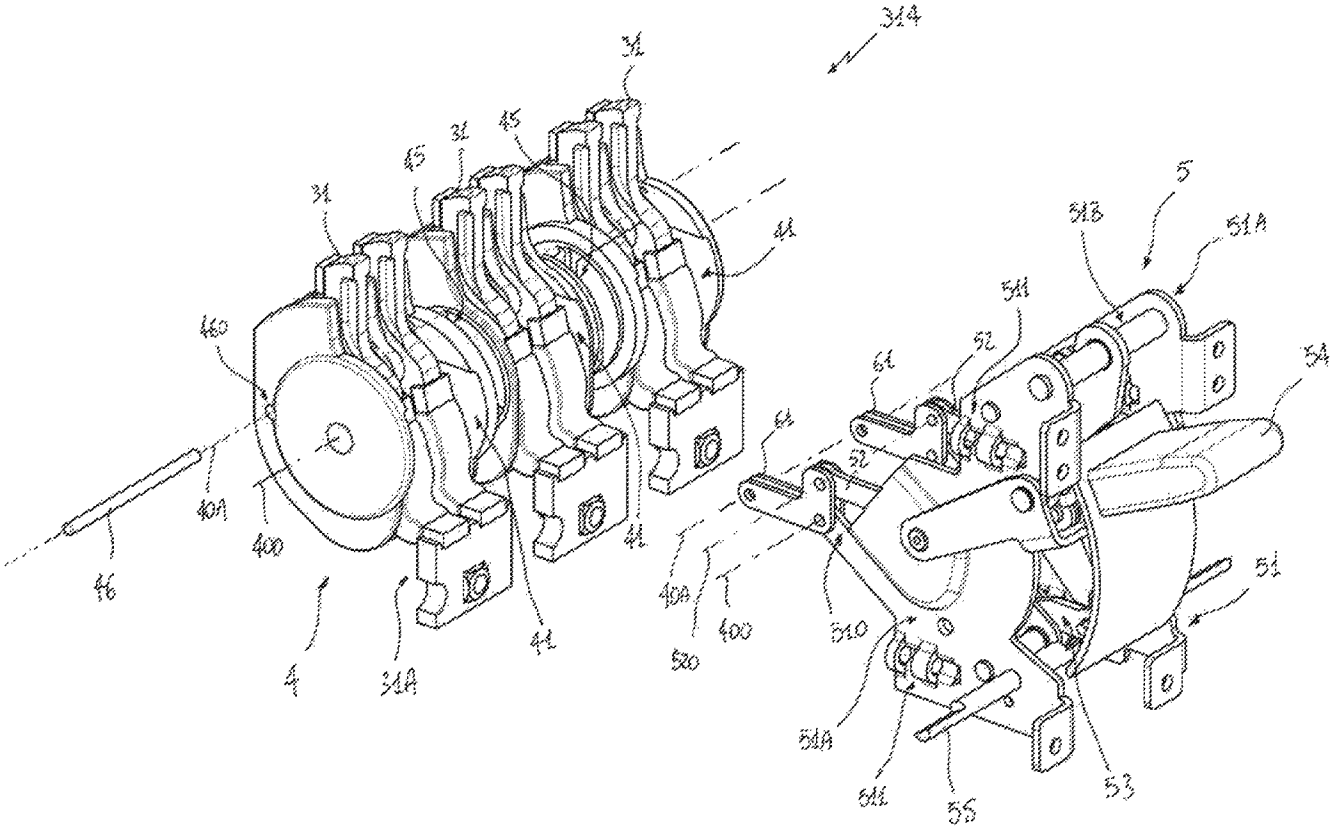

As is shown in FIG. 1, the switching device 1 may comprise also a relay 300 for controlling the operation of the switching device. In a normal vertical installation of the switching device, the relay 300 is preferably mechanically coupled to a bottom side of the outer casing 2. According to the invention, the switching device 1 comprises also one or more electric poles 3.

Each electric pole 3 comprises one or more mobile contacts 31 and one or more fixed contacts 32 adapted to be coupled or uncoupled during a switching operation (e.g. an opening or a closing manoeuvre) of the switching device.

When the electric contacts 31, 32 are coupled, the switching device 1 is in a closing state whereas, when the electric contacts 31, 32 are uncoupled, the switching device 1 is in an opening state.

In the embodiments shown in the cited figures, the switching device 1 is of the three-phase type and comprises three electric poles, each comprising a plurality of fixed contacts 32 and a plurality of mobile contacts 31, which can be coupled or uncoupled during a switching operation of the switching device.

Other solutions are however possible depending on the specific application of the switching device 1.

In some embodiments (as shown in the cited figures) of the switching device, each mobile contact 31 may be electrically connected to electrical connection means 31A that are in turn electrically connected to an electric power distribution line. As an example, the electrical connection means 31A comprises one or more conductive braids electrically to one or more electrodes.

According to alternative embodiments (FIG. 9A) of the switching device, each mobile contact 31 may be adapted to be coupled/uncoupled at its opposite ends with a corresponding pair of fixed contacts 32 (double breaking configuration).

Further solutions are possible depending on the specific application of the switching device 1. According to the invention, the switching device 1 comprises a contact shaft 4 that is accommodated in the internal volume of the switching device, namely in the internal volume portion 101 thereof.

The contact shaft 4 is adapted to rotate about a rotation axis 400 during a switching operation of the switching device.

The contact shaft 4 has an elongated shaped body extending longitudinally along its rotation axis 400 and at least partially made of an insulating material (e.g. a thermosetting resin).

Preferably, the geometry of said shaped body is substantially of cylindrical type.

The body of the contact shaft 4 comprises one or more contact seats 41 adapted to accommodate at least partially one or more mobile contacts 31.

In this way, the mobile contacts 31 and the contact shaft 4 (and possibly the electrical connection means 31A) form a mobile contact assembly 314 rotating about the rotation axis 400 during a switching operation of the switching device.

Preferably, the contact shaft 4 comprises a seat 41 for each electric pole 3 of the switching device, which is configured to accommodate the mobile contacts 31 of the corresponding electric pole. Each seat 41 can thus accommodate one or more mobile contacts 41.

Preferably, the seats 41 are configured so that the mobile contacts 31 protrude from the contact shaft 4 perpendicularly with respect to the longitudinal axis 400.

Preferably, the seats 41 are mutually adjacent and are configured so that the mobile contacts 31 accommodated therein have a common axis of rotation 400 with the contact shaft 4.

Preferably, the switching device 1 comprises second fastening means (not shown) to mechanically connect the mobile contacts 31 with the contact shaft 4 at the seats 41 of this latter. Said second fastening means may be of known type, such as pins, screws or tie-rods. In the embodiments shown in the cited figures, each seat 41 is advantageously configured so as to accommodate a pair of mobile contacts 31 and the electrical connection means 31A electrically connected to said pair of mobile contacts.

The seats 41 are preferably configured so that the mobile contacts 31 and the electrical connection means 31A protrude from the contact shaft 4 perpendicularly with respect to the longitudinal axis 400, at opposite sides of the contact shaft.

Other solutions are however possible depending on the specific application of the switching device 1.

According to the invention, the switching device 1 comprises a control mechanism 5 for operating the contact shaft 4.

Preferably, the control mechanism 5 is accommodated in the second internal volume portion 102.

The control mechanism 5 comprises a supporting frame 51 fixed to the outer casing 2 to provide support to movable members of the control mechanism.

Preferably, the supporting frame 51 comprises shaped lateral portions 51A that are spaced one to another. The lateral portions 51A may be formed by suitably shaped metal plates.

Preferably, the supporting frame 51 comprises one or more transversal portions 51B positioned between the lateral portions 51A and mechanically connected to these latter to increase the overall mechanical rigidity of the supporting frame. The transversal portions 51B may be formed by suitable tie rods or pins (as shown in FIGS. 1-9) or by suitably shaped metal plates (as shown in FIG. 10).

Preferably, the supporting frame 5 comprises supporting frame portions 510 arranged to pass through the front portion 22 of the outer casing 2 at suitable first openings (not shown) of said front portion.

In this way, the supporting frame portions 510 protrude at least partially within the first internal volume portion 101 where the contact shaft is positioned.

Preferably, the supporting frame portions 510 are formed by first shaped protrusions of the lateral portions 51A of the supporting frame 51.

Preferably, the supporting frame 51 comprises fastening portions 511 adapted to allow the mechanical connection of the supporting frame 51 with the outer casing 2.

Preferably, the fastening portions 511 are formed by second shaped protrusions of the lateral portions 51A of the supporting frame 51.

Preferably, the switching device 1 comprises third fastening means 150 for the mechanical coupling of the outer casing 2 with the supporting frame 5 at the fastening portions 511. The fastening means 150 may be of known type, such as screws, bolts or tie-rods.

The control mechanism 5 comprises one or more connecting rods 52 adapted to provide a force to move the contact shaft 4 during a switching operation of the switching device.

Preferably, the connecting rods 52 are arranged to pass through the front portion 22 of the outer casing 2 at suitable second openings (not shown) of said front portion. In this way, the connecting rods 52 protrude at least partially within the first internal volume portion 101 where the contact shaft is positioned.

Preferably, the connecting rods 52 are operatively connected to one or more actuating members 53 of the control mechanism, which are configured to suitably actuate the connecting rods 51.

Preferably, the control mechanism 5 comprises an actuating shaft 55 operatively connected to the actuating members 53 of the control mechanism, which can be actuated by an actuating device for operating the switching device 1.

In the embodiment shown in FIG. 1-9, the control mechanism 5 comprises an actuating lever 54 operatively connected to the actuating members 53 of the control mechanism, which can be manually actuated by a user for operating the switching device 1.

In the embodiment shown in FIG. 10, the control mechanism 5 comprises a loading lever 550 for actuating the actuating shaft 55.

Further solutions are however possible depending on the specific application of the switching device 1.

According to the invention, the switching device 1 comprises one or more coupling elements 61 adapted to support the contact haft 4 and provide a mechanical connection between the control mechanism 5 and the contact shaft 4.

Preferably, each coupling element 61 is at least partially accommodated in a corresponding coupling recess 45 of the contact shaft 4.

Preferably, each coupling recess 45 is arranged between a pair of adjacent contact seats 41 of the contact shaft 4.

According to the invention, each coupling element 61 comprises a first coupling point 611, at which said coupling element is fixed to the contact shaft 4.

In this way, the coupling elements 61 provide support to the said contact shaft 4 and maintain it in a relative position with respect to the outer casing 2.

More particularly, the coupling elements 61 maintain the contact shaft 4 in a suspended position within the first internal volume portion 101, so that the contact shaft 4 is free to rotate about the rotation axis 400.

Figures 4, 4C:
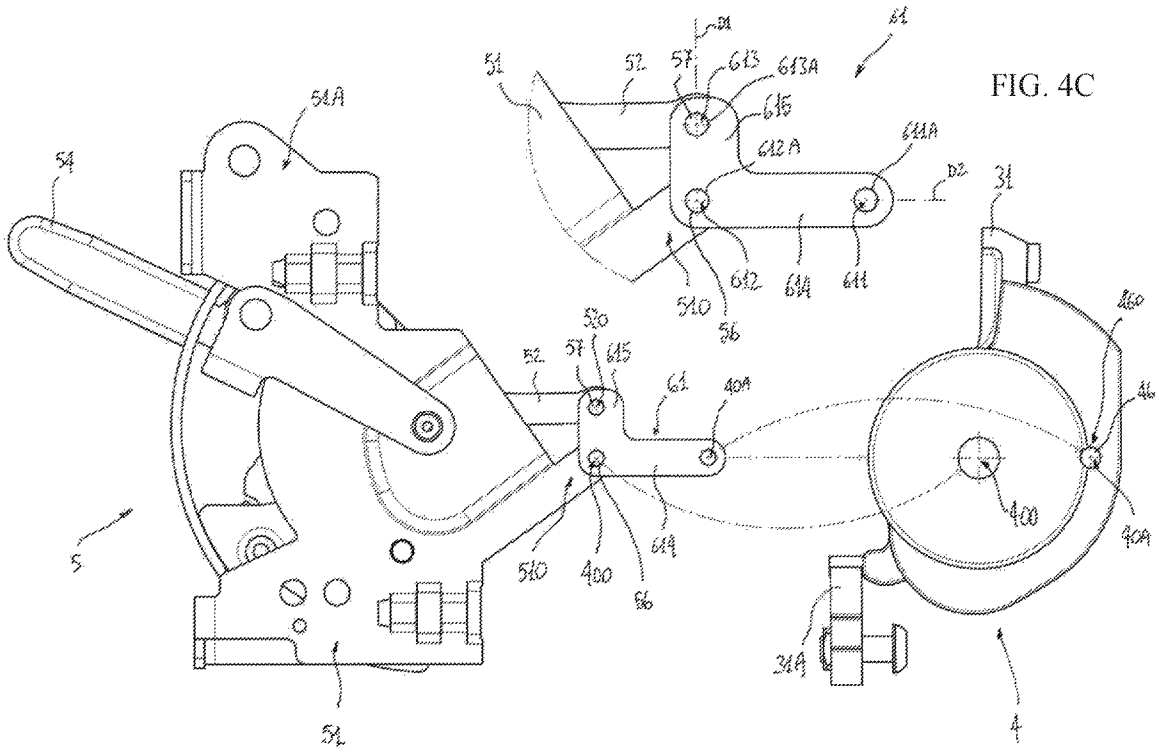

Preferably, the coupling elements 61 comprise first coupling seats 611A (e.g. formed by through holes) at the first coupling points 611 (FIG. 4C).

Preferably, the contact shaft 4 comprises one or more fixing points 40, at which the coupling elements 61 are fixed to the contact shaft 4 at the first coupling points 611 (FIG. 9).

Preferably, the first coupling points 611 of the coupling elements 611 and the corresponding fixing points 40 of the contact shaft 4 are aligned along a fixing axis 40A, which is substantially parallel to the rotation axis 400 and spaced from this latter.

In practice, the fixing axis 40A is positioned in an eccentric position with respect to a transversal section of the contact shaft 40, which is perpendicular to the rotation axis 400.

This solution provides relevant advantages with respect to traditional switching devices.

The position of the fixing axis 40A may be suitably designed to facilitate the mounting of the contact shaft 4.

The contact shaft 4 may be mounted/removed as a whole without intervening on the mobile contacts 31 operatively connected with the contact shaft at the rotation axis 400 (i.e. along a fixing axis different from the fixing axis 40A).

This remarkably facilitates the assembly of the switching device and the execution of possible maintenance interventions.

Mechanical efforts are transmitted at portions (made of plastic material) of the contact shaft 4, which are spaced from the mobile contacts 31.

This improves the overall robustness of the mobile contact assembly formed by the contact shaft 4 and mobile contacts 31.

Finally, this solution facilitates the electrical insulation between the mobile contacts 31 and the coupling elements 61 (and the parts of the control mechanism 5 connected thereto).

Preferably, the switching device 1 comprises fixing means 46 to fix the coupling elements 61 to the contact shaft 4.

As shown in the cited figures, the fixing means 46 may comprise an elongated fixing pin that is inserted in a fixing cavity 460 of the contact shaft 4, which extends longitudinally along the fixing axis 40A. At the fixing points 40 of the contact shaft 4, the fixing pin 46 passes through the first coupling seats 611A of the coupling elements 61.

As an alternative (not shown), the fixing means 46 may comprise a fixing pin for each coupling element 61. Each fixing pin is inserted in the fixing cavity 460 and is mechanically coupled to a corresponding coupling element 61 at a first coupling seat 611A thereof. Further solutions (e.g. snap-fit connections) are possible according to the needs.

According to the invention, each coupling element 61 comprises also a second coupling point 612 (spaced from the coupling point 611), at which said coupling element is hinged with a corresponding supporting frame portion 510 of the supporting frame 51 of the control mechanism 5.

In this way, the coupling elements 61 provide a centre of rotation for the contact shaft 4 about the rotation axis 400.

As they are coupled with the supporting frame 5 that is in turn solidly fixed with the outer casing 2, the coupling elements 61 fix the position of the rotation axis 400 of the contact shaft 4 within the first internal volume portion 101 at the second coupling points 612 that are spaced from the first coupling points 611.

As they are fixed to the contact shaft 4 at the first coupling points 611, the coupling elements 61 rotate solidly with the contact shaft 4 about the rotation axis 400 at the rotation centres formed by the second coupling points 612.

Figure 4B:
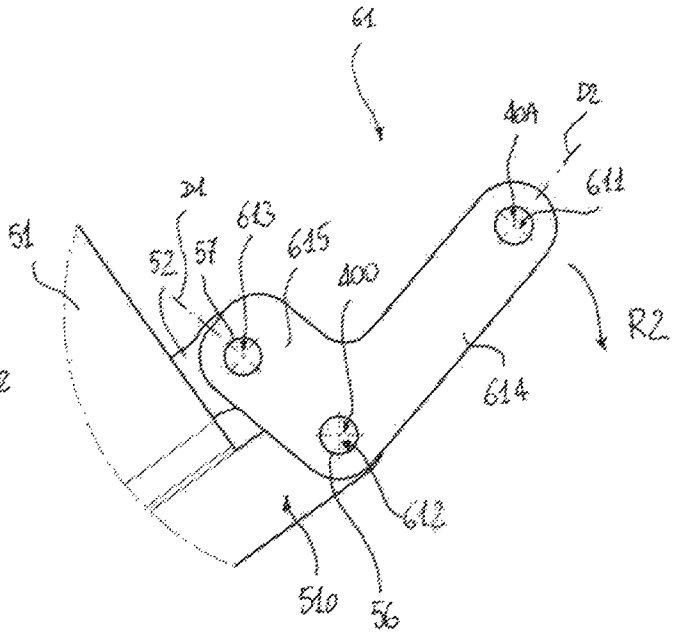
Figure 4A:
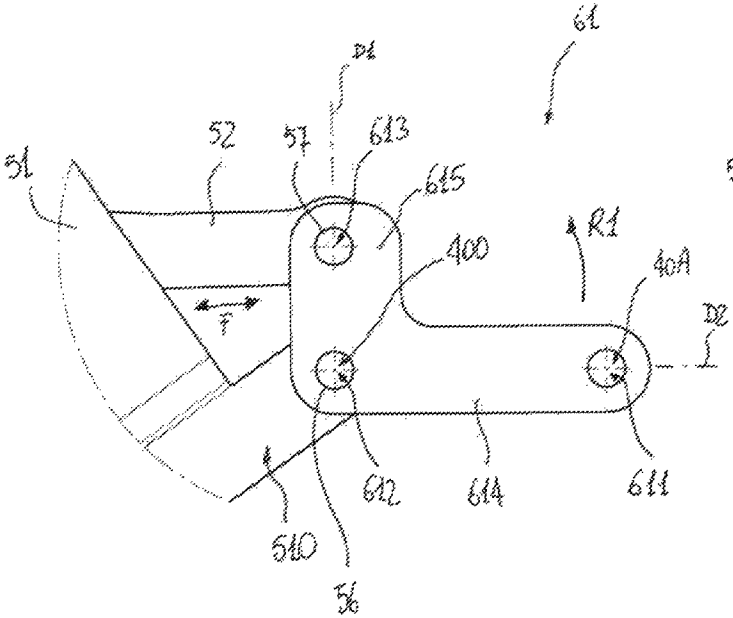

Referring to FIGS. 4A-4B, the movements of the coupling elements 61 during the switching operations of the switching device are schematically represented.

In FIG. 4A, the coupling elements 61 are positioned in a first operating position corresponding to a coupling position of the electric contacts 31, 32 (the switching device is in a closing state).

In FIG. 4B, the coupling elements 61 are positioned in a second operating position corresponding to a coupling position of the electric contacts 31, 32 (the switching device is in a opening state).

During an opening or closing manoeuvre of the switching device, the coupling elements 61 rotate about the rotation axis 400 together with the contact shaft 4 and the mobile contacts 31, respectively according to a rotation direction R1 or a rotation direction R2 mutually opposite one to another.

Preferably, the coupling elements 61 comprise second coupling seats 612A (e.g. formed by through holes) at the second coupling points 612 (FIG. 4C).

Preferably, the supporting frame portions 510 comprise one or more first hinging points 510A, at which the coupling elements 61 are hinged to the supporting frame 5 at the second coupling points 612 (FIG. 10).

Preferably, the second coupling points 612 of the coupling elements 61 and the corresponding first hinging points 510A of the supporting frame portions 510 are aligned along a same first hinging axis that coincides with the rotation axis 400 of the contact shaft.

Preferably, the supporting frame portions 510 comprise one or more first hinging seats 510B (e.g. formed by through holes) at the first hinging points 510A (FIG. 10).

Preferably, the switching device 1 comprises first hinging means 56 to hinge the coupling elements 61 with corresponding supporting frame portions 510.

As shown in FIGS. 1-9, the first hinging means 56 may comprise one or more first hinging pins, each of which passes through the second coupling seat 612A of a coupling element 61 and the first hinging seat 510B of a corresponding supporting frame portion.

As an alternative (FIG. 10), the fixing means 56 may comprise a single elongated pin passing through the second coupling seats 612A of the coupling elements 61 and the first hinging seats 510B of the supporting frame portions 510.

Further solutions (e.g. snap-fit connections) are possible according to the needs.

According to the invention, each coupling element 61 comprises also a third coupling point 613 (spaced from the coupling points 611, 612), at which said coupling element is hinged with a corresponding connecting rod 52 of the control mechanism 5.

In this way, the coupling elements 61 are subject to a force F exerted by the connecting rods 52 to rotate said coupling elements and the contact shaft 4 about the rotation axis 400, during a switching operation of the switching device.

Referring to FIGS. 4A-4B, the direction of the force F exerted by the connecting rods 52 depends on whether the switching device 1 is performing an opening manoeuvre or a closing manoeuvre.

It is however evident that the coupling elements 61 are capable to transform a translation force F exerted by the connecting rods 52 in a rotational force transmitted to the mobile contact assembly 314.

Preferably, the coupling elements 61 comprise third coupling seats 613A (e.g. formed by through holes) at the third coupling points 613 (FIG. 4C).

Preferably, the connecting rods 52 comprise one or more second hinging points 52A at which the coupling elements 61 are hinged to said connecting rods at the third coupling points 613 (FIG. 10).

The third coupling points 613 of the coupling elements 61 and the corresponding second hinging points 52A of the connecting rods 52 are aligned along a second hinging axis 520 parallel with the rotation axis 400 and spaced from this latter.

Advantageously, the distance between the axes 520, 400 may be selected as a function to the force to be transmitted to the mobile contact assembly 314.

Preferably, the connecting rods 52 comprise one or more second hinging seats 52B (e.g. formed by through holes) at the hinging points 52A (FIG. 10).

Preferably, the switching device 1 comprises second hinging means 57 to hinge the coupling elements 61 with corresponding connecting rods 52.

As shown in FIGS. 1-9, the second hinging means 57 comprise one or more second hinging pins, each of which passes through the third coupling seat 613A of a coupling element 61 and the second hinging seat 52B of a corresponding connecting rod 52.

As an alternative (FIG. 10), the fixing means 57 may comprise a single elongated pin passing through the third coupling seats 613A of the coupling elements 61 and the second hinging seats 52B of the connecting rods 52.

Further solutions (e.g. snap-fit connections) are possible according to the needs.

According to an aspect of the invention (as shown in the cited figures), each coupling element 61 is configured as a lever (namely a lever of the first type with intermediate fulcrum), in which the first coupling point 611 is the point of the lever on which a mechanical load (the mobile contact assembly 314) is applied, the second coupling point 612 is the fulcrum point of the lever and the third coupling point 613 is the point of the lever on which a force (the force F exerted by the connecting rods 52) is applied.

Preferably, each coupling element 61 comprises at least a supporting portion 614 fixed with the contact shaft 4 at the first coupling point 611 and hinged with a corresponding supporting frame portion 510 at the second coupling point 612 (FIG. 4).

Preferably, each coupling element 61 comprises at least a driving portion 615 hinged with a corresponding supporting frame portion 510 at the second coupling point 612 and with a corresponding connecting rod 52 at the third coupling point 613 (FIG. 4C).

The above described configuration of the coupling elements 61 provides relevant advantages in operating the contact shaft 4.

The supporting portion 614 of the coupling elements 61 may be suitably designed to optimize the mechanical support of the contact shaft 4, e.g. as a function of the size and weight of this latter, whereas the driving portion 615 of the coupling elements 61 may be suitably designed to optimize the actuation of the contact shaft 4, e.g. as a function of the size and weight of this latter and of force provided by the control mechanism 5.

Both the supporting and driving portions 614, 615 may be suitably designed for reducing the overall size and improving the overall structural integration.

According to an aspect of the invention, each coupling element 61 is formed by at least a shaped plate comprising a supporting leg 614 and a driving leg 615, which form the above mentioned supporting portion and driving portion, respectively.

Preferably, said at least a shaped plate is configured to operate as a lever of the first kind with intermediate fulcrum.

Preferably, said at least a shaped plate is L-shaped.

Preferably, each coupling element 61 is formed by a pair of L-shaped plates mutually joined and parallel one to another (FIGS. 1-9).

Preferably, said L-shaped plates are joined at the coupling points 611, 612, 613 by means of the fixing means 46 and the hinging means 56, 57 described above.

As an alternative (FIG. 10), each coupling element 61 is formed by a single L-shaped plate.

Preferably, the supporting leg 614 of a L-shaped plate extends between the first and second coupling points 611, 612 whereas the driving leg 615 of a L-shaped plate extends between the second and third coupling points 612, 613.

Figure 5:
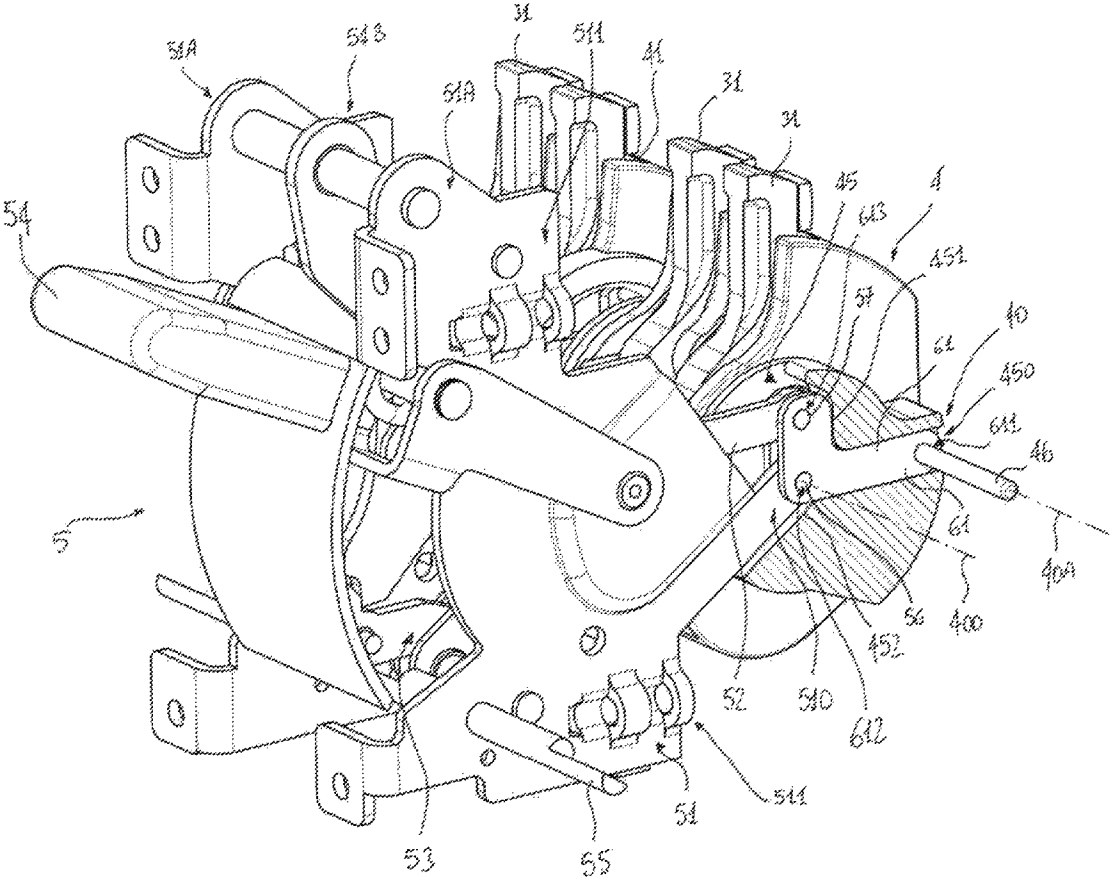
Figure 6:
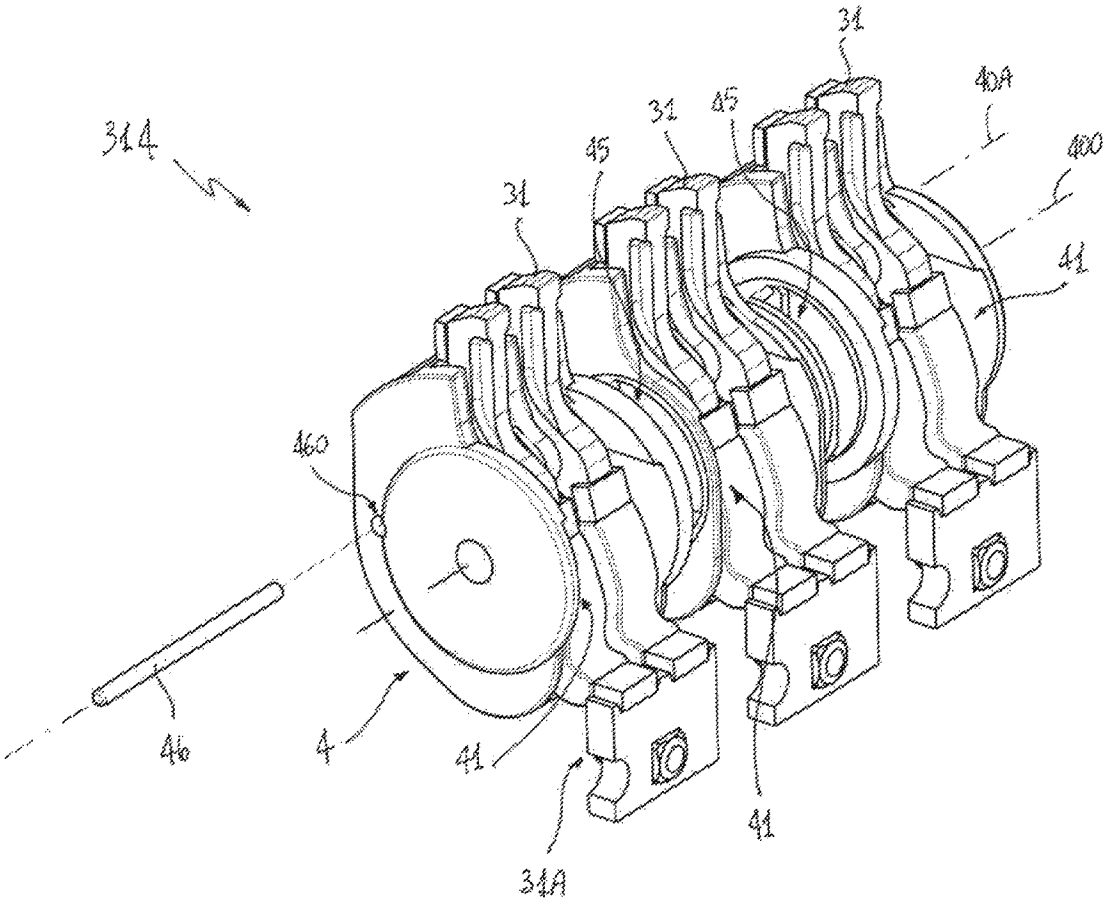
Figure 7:
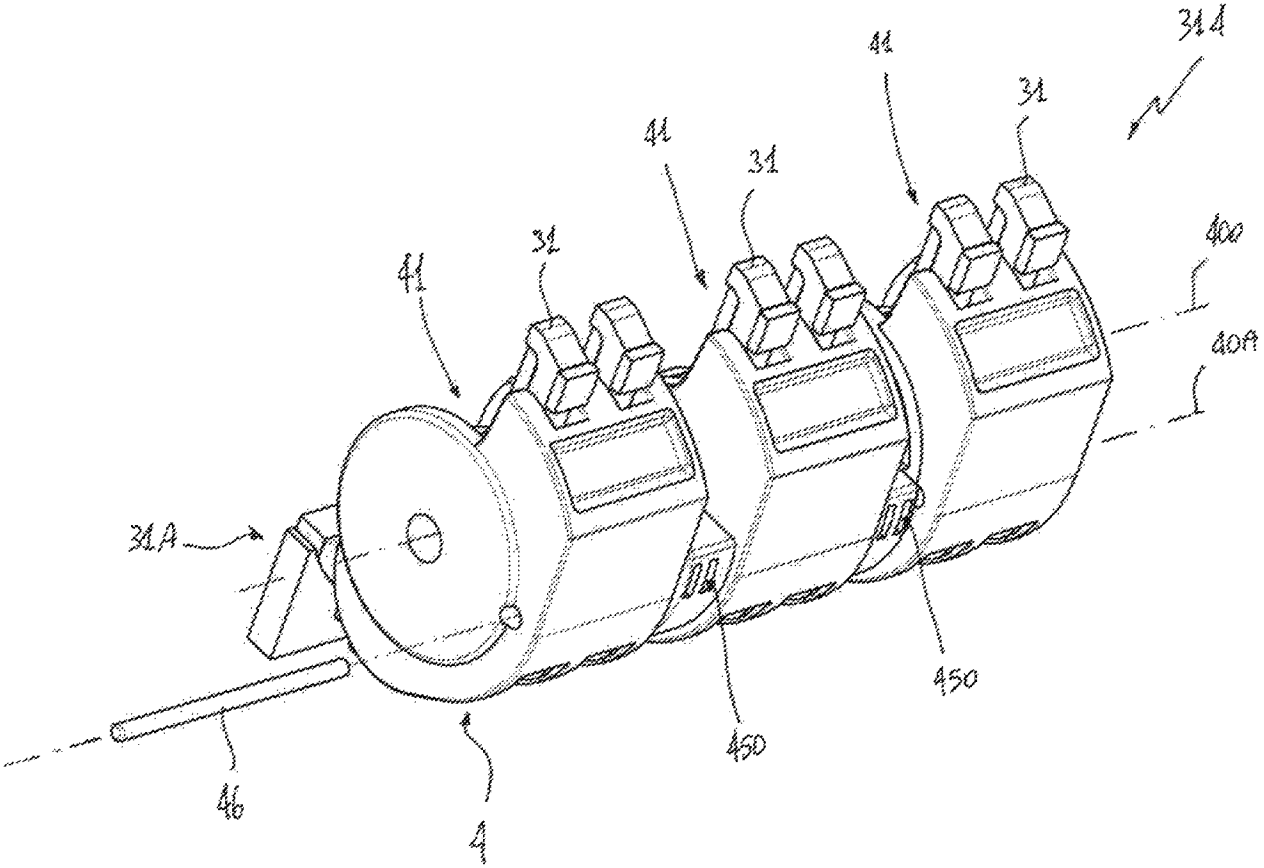
Figure 8:
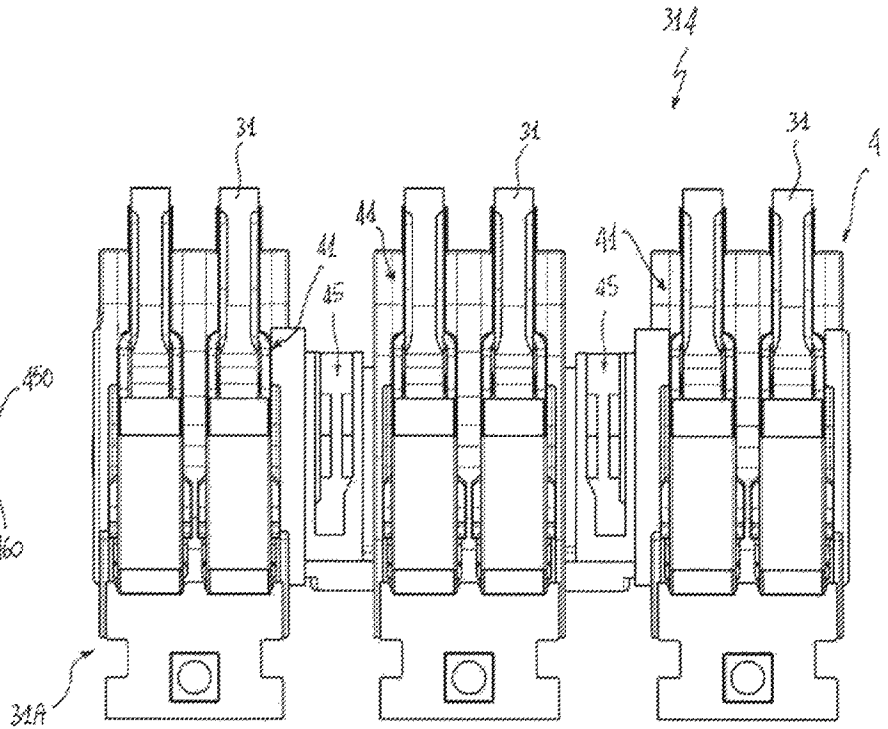
Figure 8A:
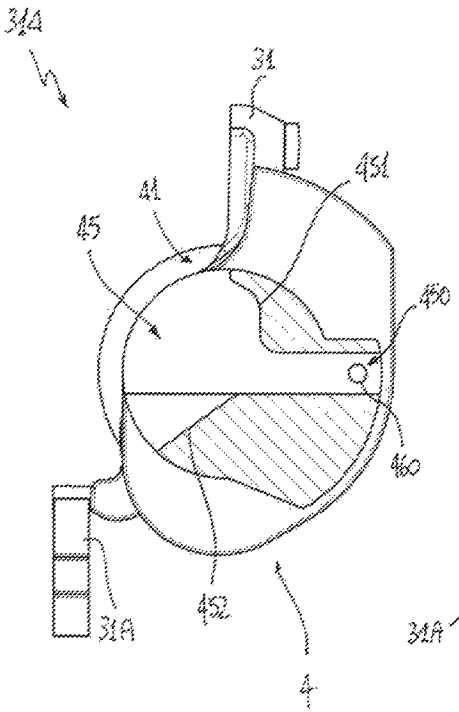

Preferably, the supporting leg 614 and the driving leg 615 of a L-shaped plate are coplanar and extend along extension directions D1, D2 crossing at the second coupling point 612 (FIGS. 4-5).

Preferably, the extension directions D1, D2 form an angle equal or larger than 90° at the second coupling point 612.

Preferably, the supporting leg 614 is longer than the driving leg 615.

Preferably, each coupling recess 45 of the contact shaft 4 comprises a fixing cavity 450, in which the supporting leg 614 of a corresponding L-shaped plate is inserted.

Preferably, each coupling recess 45 comprises a first abutting surface 451, to which the driving leg 615 of a corresponding L-shaped plat abuts at least partially.

Preferably, each coupling recess 45 comprises a second abutting surface 452, to which a corresponding supporting frame portion 510 abuts at least partially.

The technical solutions described above provide relevant advantages in terms of structural integration between the coupling elements 61, the connecting rods 52 and the contact shaft 4. This allows remarkably reducing the overall size of the switching device 1 with respect to traditional solutions of the state of the art.

The switching device, according to the invention, allows achieving the intended aim and objects.

The switching device, according to the invention, is characterised by a high mechanical efficiency of the moving parts in particular of the mobile contact assembly 314. The coupling elements 61, in fact, improve the robustness and stability of the mobile contact assembly 314. The switching device, according to the invention, has a compact internal structure with a limited number of components.

The coupling elements 61, in fact, remarkably simplify the positioning of the contact shaft 4 without intervening on the mobile contacts 31.

The switching device, according to the invention, is thus easier to manufacture and assembly at industrial level with respect to traditional switching devices.

Further, maintenance interventions can be easily carried out, in particular with regards to the mobile contact assembly 314.

The switching device, according to the invention, is therefore characterized by lower operating costs with respect to currently available switching devices of the traditional type.

The switching device, according to the invention, provides high performances during the switching operations.

The coupling elements 61, in fact, ensure an improved control of the movements of the mobile contact assembly 314 and a high precision of rotation of the contact shaft 4, thereby reducing the occurrence of friction and wear phenomena.

The invention claimed is:

1. A switching device comprising:

an outer casing defining an internal volume of said switching device;

one or more electric poles, each electric pole comprising one or more mobile contacts and one or more fixed contacts adapted to be coupled or uncoupled during a switching operation of said switching device;

a contact shaft accommodated in the internal volume of said switching device and adapted to rotate about a rotation axis during a switching operation of said switching device, said contact shaft having a shaped body comprising one or more contact seats adapted to accommodate at least partially said mobile contacts, so that said mobile contacts rotate with said contact shaft about said rotation axis during a switching operation of said switching device;

a control mechanism for operating said contact shaft, said control mechanism comprising a supporting frame fixed to said outer casing to provide support to movable members of said control mechanism and one or more connecting rods to provide a force to move said contact shaft during a switching operation of said switching device;

wherein the switching device comprises one or more coupling elements to support said contact shaft and provide a mechanical connection between said control mechanism and said contact shaft, said coupling elements comprising:

a first coupling point, at which said coupling elements are fixed to said contact shaft, so that said coupling elements provide support to said contact shaft and maintain said contact shaft in relative position with respect to said outer casing;

a second coupling point, at which said coupling elements are hinged with corresponding supporting frame portions of said supporting frame, so that said coupling elements provide a centre of rotation for said contact shaft about said rotation axis;

a third coupling point, at which said coupling elements are hinged with corresponding connecting rods of said control mechanism, so that said connecting rods exert a force on said coupling elements to rotate said coupling elements and said contact shaft about said rotation axis, during a switching operation of said switching device, wherein said coupling elements are configured as a lever, in which said first coupling point is a point of said lever on which a mechanical load is applied, said second coupling point is a fulcrum point of said lever and said third coupling point is another point of said lever on which a force is applied.

2. The switching device, according to claim 1, wherein said coupling elements comprise:

at least a supporting portion, which is fixed with said contact shaft at said first coupling point and which is hinged with a corresponding supporting frame portion at said second coupling point;

at least a driving portion, which is hinged with a corresponding connecting rod at said third coupling point and which is hinged with a corresponding supporting frame portion at said second coupling point.

3. The switching device, according to claim 2, wherein said coupling elements are formed by at least a L-shaped plate, said L-shaped plate comprising a supporting leg forming said supporting portion and a driving leg forming said driving portion.

4. The switching device, according to claim 3, wherein said supporting leg and said driving leg extend along coplanar directions forming an angle equal or larger than 90° at said second coupling point.

5. The switching device, according to claim 4, wherein said coupling elements are formed by a pair of L-shaped plates, which are joined one to another and positioned parallel one to another.

6. The switching device, according to claim 3, wherein said coupling elements are formed by a pair of said L-shaped plates, which are joined one to another and positioned parallel one to another.

7. The switching device, according to claim 3, wherein a coupling recess of said contact shaft comprises at least a fixing cavity, in which the supporting leg of a corresponding L-shaped plate is inserted.

8. The switching device, according to claim 3, wherein coupling recesses of said contact shaft comprise at least a first abutting surface, to which the driving leg of a corresponding L-shaped plate abuts at least partially.

9. The switching device, according to claim 8, wherein said coupling recesses comprise at least a second abutting surface, to which a supporting frame portion abuts at least partially.

10. The switching device, according to claim 3, wherein a coupling recess of said contact shaft comprises at least a fixing cavity, in which the supporting leg of a corresponding L-shaped plate is inserted, and said coupling recess comprises at least a first abutting surface, to which the driving leg of a corresponding L-shaped plate abuts at least partially.

11. The switching device, according to claim 1, wherein said coupling elements are at least partially accommodated in corresponding coupling recesses of said contact shaft.

12. The switching device, according to claim 11, wherein said contact shaft comprises a plurality of mutually adjacent contact seats for accommodating said mobile contacts, each coupling recess of said contact shaft being arranged between a pair of adjacent contact seats of said contact shaft.

13. The switching device, according to claim 11, wherein each coupling recess comprises at least a fixing cavity, in which a supporting leg of a corresponding L-shaped plate is inserted.

14. The switching device, according to claim 11, wherein said coupling recesses comprise at least a first abutting surface, to which a driving leg of a corresponding L-shaped plate abuts at least partially.

15. The switching device, according to claim 11, wherein said coupling recesses comprise at least a second abutting surface, to which a supporting frame portion abuts at least partially.

16. The switching device, according to claim 1, which further comprises fixing means to fix said coupling elements to said contact shaft.

17. The switching device, according to claim 1, which further comprises first hinging means to hinge said coupling elements with corresponding supporting frame portions.

18. The switching device, according to claim 1, which further comprises second hinging means to hinge said coupling elements with corresponding connecting rods.

19. The switching device, according to claim 1, wherein said coupling elements are at least partially accommodated in corresponding coupling recesses of said contact shaft.

20. The switching device, according to claim 19, wherein said contact shaft comprises a plurality of mutually adjacent contact seats for accommodating said mobile contacts, each coupling recess of said contact shaft being arranged between a pair of adjacent contact seats of said contact shaft.

* * * * *